United States Patent [19]

Glazier

[11] 4,053,760

[45] Oct. 11, 1977

[54] WARNING LIGHT GUARD

[76] Inventor: Charles A. Glazier, 445 Orange Ave., West Haven, Conn. 06516

[21] Appl. No.: 684,549

[22] Filed: May 10, 1976

[51] Int. Cl.[2] ..... F21V 15/00

[52] U.S. Cl. ..... 362/186; 362/396

[58] Field of Search ..... 240/52.1, 54

[56] References Cited

U.S. PATENT DOCUMENTS

| | | | |
|---|---|---|---|
| 811,810 | 2/1906 | Wood | 240/54 R |
| 1,403,935 | 1/1922 | Beer | 240/54 A UX |
| 1,448,345 | 3/1923 | Hawkins | 240/54 R |
| 2,569,068 | 9/1951 | Maxwell | 240/54 A |
| 2,777,052 | 1/1957 | Combs | 240/52.1 X |

FOREIGN PATENT DOCUMENTS

| | | | |
|---|---|---|---|
| 839,829 | 5/1952 | Germany | 240/52.1 |
| 20,882 | 9/1909 | United Kingdom | 240/54 R |

*Primary Examiner*—Donald A. Griffin

*Attorney, Agent, or Firm*—DeLio and Montgomery

[57] ABSTRACT

A protective guard for warning lights, such as those displayed around construction sites, which includes a rectangular metal base adapted to enclose the lower or battery portion of the light, an arched wall proportioned to extend up and over the lamp portion of the light, front and back grids fixed to the arched wall to protect the lamp portion while permitting light to shine through in at least two opposite directions and a mounting bracket fixed to the base and adapted for use in securing the light and guard to a support such as a metal drum or barrier, whereby the warning light is protected against theft and accidental or malicious damage.

5 Claims, 3 Drawing Figures

WARNING LIGHT GUARD

This invention relates to a guard for warning lights, such as those commonly displayed around highway or building construction sites as a warning to motorists and pedestrians.

Warning lights have been and are of various types including kerosene lanterns, gas or electric lanterns, with steady or flashing lights, constructed for all-around visibility or directionally exposed. All such lights have proved to be tempting targets for theft or vandalism, and lantern supports with locking means to prevent theft have long been known. At the present time, however, it is found that a flashing warning light securely installed at a construction site (such as a highway operation requiring digging) may have an effective life of no more than a few minutes or hours before being stolen or broken. Such vandalism is expensive in the loss of lights and also creates hazards by removal of the warning at an area of danger.

It is accordingly an object of the present invention to provide a simple, strong guard for warning lights, which can be attached to a support in a manner that makes unauthorized removal very difficult and which physically protects vulnerable portions of the light from damage, as by sticks or stones, while permitting the light bulb to be clearly seen in operation.

It is another object of the invention to provide a bracket adapted for securement to any customary support.

It is a further object of the invention to provide a guard having a single means for locking the light assembly in the guard and for fixing the guard on a support.

It is yet another object of the invention to provide certain improvements in the form, construction and arrangement of the several parts whereby the above named and other objects may effectively be attained.

The invention accordingly comprises an article of manufacture possessing the features, properties, and the relation of elements which will be exemplified in the article hereinafter described, and the scope of the invention will be indicated in the claims.

A practical embodiment of the invention is shown in the accompanying drawing wherein.

Figure 1:
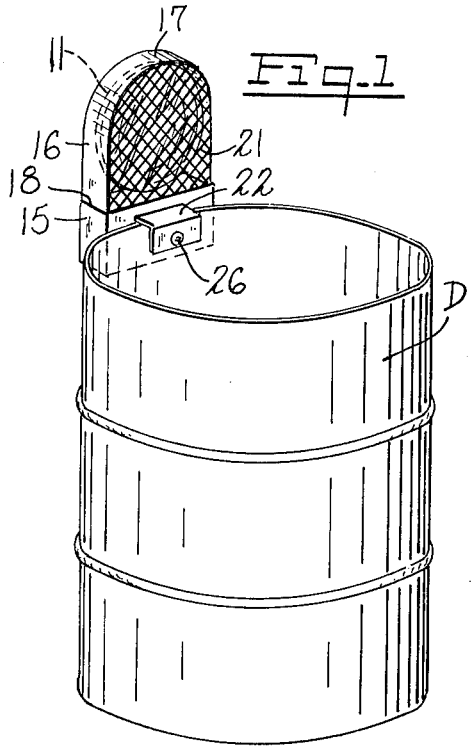
FIG. 1 represents a perspective view of the light guard mounted on a metal drum.
Figure 2:
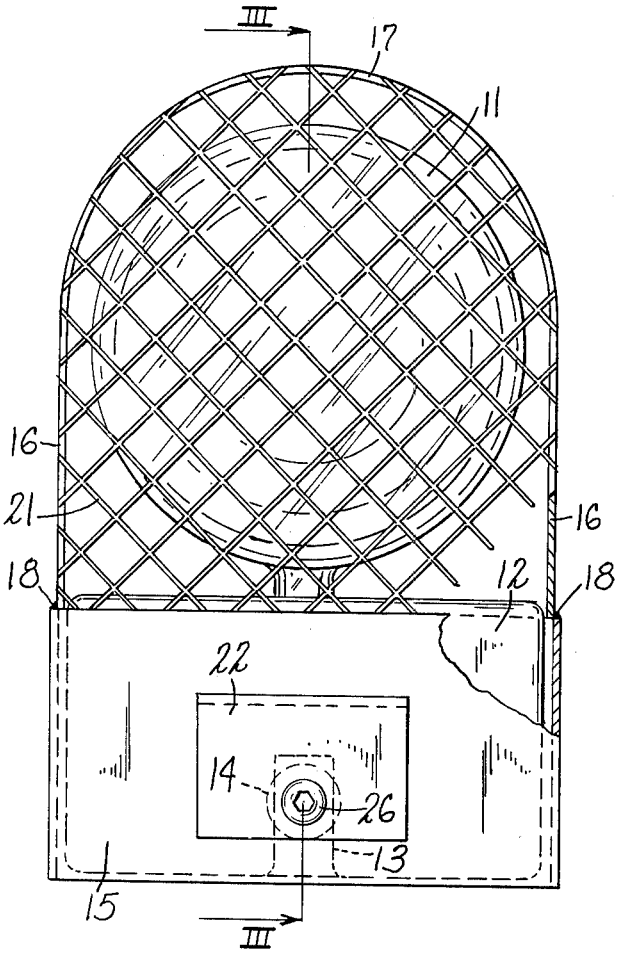
FIG. 2 represents an elevation, from the bracket side, of the light guard.

Referring to the drawing, a typical form of warning light comprises the lamp portion 11, which includes lenses on both sides and which may be colored as desired, and the battery housing 12, which also contains a switch and/or timer and/or flashing mechanism, according to the model of the light. The housing 12 is recessed at 13 with an anchoring nut 14 set into the rear wall of the recess.

To accomodate a light of the type just described, the guard comprises a rectangular base 15 which may be formed by a steel strap of suitable width bent into a rectangle and welded closed at one corner. The upper sides 16 and top 17 of the guard are formed also by a steel strap or band welded at its ends 18 to the upper edges of the base at its short sides. The arch constituted by the guard portions 16, 17 is of a size and shape to fit freely around and spaced from the lamp portion of the light, the shape and size being subject to modification in guards designed for different lights. The open sides of the arch are occupied by grids 20, 21 which may be stamped from a steel plate or cut from heavy steel mesh material, and which are welded to the edges of the arch and base.

A mounting bracket 22 projects outwardly and downwardly from the middle portion of the base and is provided with a hole 23, in alignment with a hole 24 in the base and with the bore of the anchoring nut 14, to receive the bolt 25. This bolt is of a length to be tightened firmly against the bracket with its threaded end in the nut 14, and it is preferably made with a round head 26 and a special socket which cannot be engaged by an ordinary screwdriver or by a Phillips head screwdriver. A modified Allen socket is satisfactory.

Figure 3:
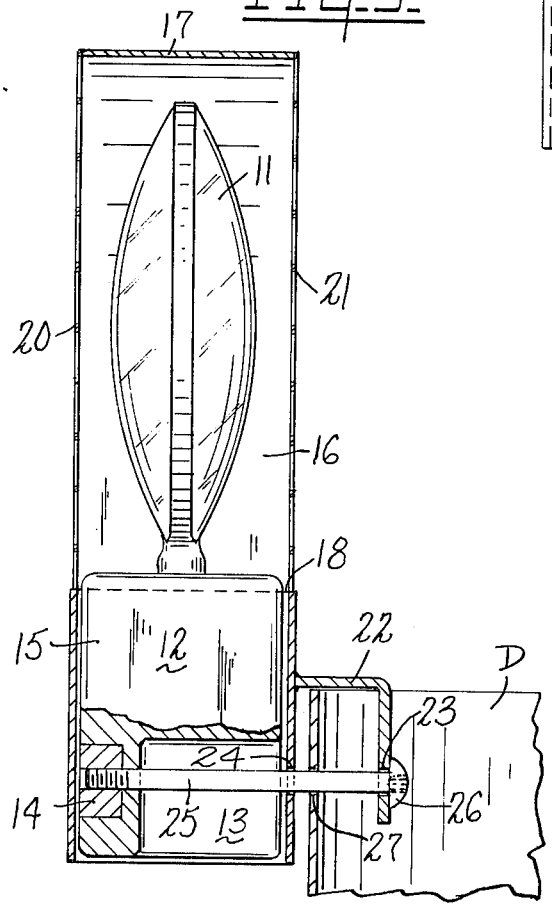
FIG. 3 represents a vertical section on the line III—III of FIG. 2.

In FIGS. 1 and 3 the light and guard are shown mounted on the edge of a steel drum D, which is inherently heavy and may be additionally weighted, by engagement of the bolt 25 with a hole 27 in the wall of the drum. The bracket is so dimensioned that it can also fit over the upper edge of a wood or metal barrier, bored to receive the bolt, if desired.

In operation, the light assembly is inserted in the guard through the open bottom of the latter and is held there manually while the guard and light are fitted onto the edge of a support (drum or barrier), the bolt being then inserted and screwed home by means of a special wrench.

The guard is strong enough to resist deformation by anything less than a very powerful blow and the grid openings are small enough to block out any stones of a dangerous size. The mounting arrangement is such that separation of the lamp from the guard is impossible without removing the bolt, and that is impossible without a special instrument.

It will be appreciated that the guard shown herein is specifically designed for use with one specific form of warning light and that the dimensions and details of the guard are subject to modification as required to fit lights of different shapes and sizes. It may also be noted that the materials used, their manner of assembly and the resulting product are of a different nature from anything found in guard devices presently used on lights such as "trouble lights" (molded plastic guards), gymnasium lights (wire mesh), and the like.

It will thus be seen that the object set forth above, among those made apparent from the preceding description, are efficiently attained and, since certain changes may be made in the above article without departing from the spirit and scope of the invention, it is intended that all matter contained in the above description and shown in the accompanying drawing shall be interpreted as illustrative and not in a limiting sense.

What I claim is:

1. A warning light guard comprising, a rectangular base portion adapted to enclose laterally the battery housing portion of a warning light, an upper portion fixed on the base and including a solid metal band fitting freely around the lamp portion of the light and a strong substantially flat metal grid covering the space between the upper edges of the base portion and the edges of said band, and a mounting bracket fixed on the base portion, for attachment of the guard to a support.

2. A warning light guard according to claim 1 wherein the ends of the metal band are welded to opposite edges of the base portion.

3. A warning light guard according to claim 1 wherein the base portion is open downwardly, the mounting bracket projects laterally and downwardly from one side of the base portion, and which includes means for holding a warning light in the guard and for mounting the guard and light on a support.

4. A warning light guard comprising a downwardly open base portion adapted to enclose laterally the lower portion of a warning light, an upper portion fixed on the base and including a solid metal band fitting freely around the lamp portion of the light and a strong metal grid covering the space between the upper edges of the base portion and the edges of said band, a mounting bracket projecting laterally and downwardly from one side of the base portion, for attachment of the guard to a support, and means for holding a warning light in the guard and for mounting the guard light on a support, the guard being adapted for use with a warning light having a nut in its base, and the means for holding the light and mounting the guard and light on a support comprising a bolt adapted to pass through the mounting bracket, a portion of a support, a hole in the guard base portion and the bore of the nut in the lamp base.

5. A warning light guard according to claim 4 wherein the bolt is provided with a round head and specially formed socket not engageable by normal tools.

* * * * *